US009039408B2

(12) United States Patent
Kato et al.

(10) Patent No.: US 9,039,408 B2
(45) Date of Patent: May 26, 2015

(54) COMBUSTOR WITH A COMBUSTION REGION BETWEEN AN INNER PIPE AND OUTER PIPE WITH AN IGNITION DEVICE UPSTREAM OF THE COMBUSTION REGION

(75) Inventors: Soichiro Kato, Yokohama (JP); Taku Mizutani, Yokohama (JP); Katsuyoshi Takahashi, Tokyo (JP)

(73) Assignee: IHI CORPORATION (JP)

( * ) Notice: Subject to any disclaimer, the term of this patent is extended or adjusted under 35 U.S.C. 154(b) by 700 days.

(21) Appl. No.: 13/130,111

(22) PCT Filed: Dec. 9, 2009

(86) PCT No.: PCT/JP2009/006722

§ 371 (c)(1),
(2), (4) Date: May 19, 2011

(87) PCT Pub. No.: WO2010/067595

PCT Pub. Date: Jun. 17, 2010

(65) Prior Publication Data

US 2011/0250552 A1 Oct. 13, 2011

(30) Foreign Application Priority Data

Dec. 10, 2008 (JP) ..... P2008-314690
Dec. 15, 2008 (JP) ..... P2008-318537

(51) Int. Cl.
*F23D 11/00* (2006.01)
*F23C 3/00* (2006.01)
*F23D 14/12* (2006.01)

(52) U.S. Cl.
CPC ..... *F23C 3/002* (2013.01); *F23C 2200/00* (2013.01); *F23D 2203/002* (2013.01); *F23D 14/12* (2013.01); *F23D 2207/00* (2013.01); *Y10S 165/904* (2013.01)

(58) Field of Classification Search
CPC .. F23C 3/002; F23C 3/06; F23C 2900/03005; F23C 2900/03009; F23C 2900/99006; F23Q 9/00; F23B 2900/00004
USPC ..... 431/159
See application file for complete search history.

(56) References Cited

U.S. PATENT DOCUMENTS 3,174,474 A * 3/1965 Jones et al. ..... 126/91 A
3,187,740 A * 6/1965 Jones et al. ..... 126/91 A (Continued)

FOREIGN PATENT DOCUMENTS

CN 2295913 Y 10/1998
CN 101163917 A 4/2008

(Continued)

OTHER PUBLICATIONS

Chinese Office Action, dated Jun. 18, 2013, issued in corresponding Chinese Patent Application No. 200980149165.2. English translation of only the Search Report. Total 7 pages.

(Continued)

*Primary Examiner* — Gregory Huson
*Assistant Examiner* — Martha Becton
(74) *Attorney, Agent, or Firm* — Ostrolenk Faber LLP

(57) ABSTRACT

Includes a low flow-rate region (R2) that is disposed on an upstream side of a combustion region (R1) within a second pipe (2), and that has a relatively slow flow-rate of combustion gas (G1) within the second pipe, and a flame kernel formation unit (3*a*) is disposed in the low flow-rate region.

6 Claims, 6 Drawing Sheets

(56) References Cited

U.S. PATENT DOCUMENTS

| | | | | | |
|---|---|---|---|---|---|
| 3,203,462 | A | * | 8/1965 | Prowse | 431/183 |
| 3,220,401 | A | * | 11/1965 | Jones et al. | 126/91 A |
| 3,285,240 | A | * | 11/1966 | Schmidt | 126/91 A |
| 3,334,820 | A | * | 8/1967 | Flynn | 239/556 |
| 3,688,760 | A | * | 9/1972 | Rudin | 126/91 A |
| 3,771,945 | A | * | 11/1973 | Teague, Jr. | 431/328 |
| 3,855,993 | A | * | 12/1974 | Burmeister | 126/91 A |
| 3,946,719 | A | * | 3/1976 | Bark et al. | 126/91 A |
| 4,197,831 | A | * | 4/1980 | Black | 122/18.2 |
| 4,217,088 | A | * | 8/1980 | Reed | 431/181 |
| 4,298,333 | A | * | 11/1981 | Wunning | 431/11 |
| 4,401,099 | A | * | 8/1983 | Collier | 126/91 A |
| 4,705,022 | A | * | 11/1987 | Collier | 126/91 A |
| 4,809,672 | A | * | 3/1989 | Kendall et al. | 126/91 A |
| 5,165,887 | A | * | 11/1992 | Ahmady | 431/329 |
| 5,209,893 | A | * | 5/1993 | Askin et al. | 266/47 |
| 5,224,542 | A | * | 7/1993 | Hemsath | 166/59 |
| 5,240,411 | A | * | 8/1993 | Abalos | 431/329 |
| 5,241,949 | A | * | 9/1993 | Collier | 126/91 A |
| 5,450,725 | A | | 9/1995 | Takahara | 60/737 |
| 5,695,328 | A | * | 12/1997 | DeFreitas et al. | 431/268 |
| 5,944,508 | A | * | 8/1999 | Bonnema | 431/255 |
| 5,975,887 | A | * | 11/1999 | Kamal et al. | 431/181 |
| 6,321,743 | B1 | * | 11/2001 | Khinkis et al. | 126/91 A |
| 6,588,416 | B2 | * | 7/2003 | Landais et al. | 126/91 A |
| 6,872,070 | B2 | * | 3/2005 | Moore et al. | 431/9 |
| 8,784,096 | B2 | * | 7/2014 | Mosiewicz | 431/174 |
| 2006/0244173 | A1 | * | 11/2006 | Crawford et al. | 264/176.1 |
| 2006/0246389 | A1 | * | 11/2006 | Crawford et al. | 431/328 |
| 2011/0048412 | A1 | * | 3/2011 | Kato et al. | 126/85 R |

FOREIGN PATENT DOCUMENTS

| | | | |
|---|---|---|---|
| CN | 101163918 | A | 4/2008 |
| GB | 779669 | | 7/1957 |
| GB | 1099232 | A | 1/1968 |
| GB | 2214630 | A | 9/1989 |
| JP | 61-105008 | | 5/1986 |
| JP | 01-312306 | | 12/1989 |
| JP | 06-229522 | | 8/1994 |
| JP | 2002-022109 | | 1/2002 |
| JP | 2002-349807 | | 12/2002 |
| JP | 2003-254509 | | 9/2003 |
| JP | 2003-279001 | | 10/2003 |
| JP | 2004-156862 | | 6/2004 |
| JP | 2007-32886 | | 2/2007 |
| JP | 2007-212082 | | 8/2007 |
| JP | 2008-107032 | | 5/2008 |
| RU | 2157954 | C2 | 10/2000 |
| SU | 1550278 | A1 | 3/1990 |
| TW | 200404137 | A | 3/2004 |
| TW | 200502482 | | 1/2005 |
| TW | 1237102 | | 8/2005 |

OTHER PUBLICATIONS

Notice of Allowance dated Feb..20,2013 issued in corresponding Korean Patent Application No. 10-2011-7012705 with English translation.

Office Action dated Aug. 27, 2012 issued in corresponding Taiwan Patent Application No. 098142238 with English translation (12 pages).

Taiwan Office Action, dated Jan. 16, 2013, issued in corresponding Taiwanese Application No. 098142238. English translation included. Total 13 pages.

Japanese Office Action, dated Apr. 16, 2013, issued in corresponding Japanese Application No. 2008-314690. English translation included. Total 5 pages.

International Search Report and Written Opinion mailed Feb. 16, 2010 in corresponding PCT International Application No. PCT/JP2009/00672.

Russian Federation Decision on Grant, dated Oct. 4, 2012, issued in corresponding Russian Patent Application No. 2011122979(034078), filed Dec. 9, 2009. Total 10 pages.

European Search Report, dated Dec. 23, 2014, issued in corresponding European Patent Application No. 09831702.7. Total 7 pages.

* cited by examiner

COMBUSTOR WITH A COMBUSTION REGION BETWEEN AN INNER PIPE AND OUTER PIPE WITH AN IGNITION DEVICE UPSTREAM OF THE COMBUSTION REGION

CROSS-REFERENCE TO RELATED APPLICATIONS

The present application is a 35 U.S.C. §§371 national phase conversion of PCT/JP2009/006722, filed Dec. 9, 2009, which claims priority of Japanese Patent Application Nos. 2008-314690 and 2008-318537, filed Dec. 10, 2008 and Dec. 15, 2008, respectively, the contents of which are incorporated herein by reference. The PCT International Application was published in the Japanese language.

TECHNICAL FIELD

The present invention relates to a combustor that heats combustion gas by burning combustion gas that is emitted from a first pipe via apertures that are within a flame quenching distance in a combustion region within a second pipe, and also by transferring the heat of burned gas that arises from burning of combustion gas to the combustion gas via the first pipe.

BACKGROUND ART

Previously, as a combustor which allows for size reduction, a combustor is known which burns combustion gas (an air-fuel mixture that mixes fuel and oxidants) that is emitted from a first pipe via apertures that are within a flame quenching distance in a combustion region within a second pipe.

According to this type of combustor, flame propagation to the first pipe is prevented by the apertures that are within the flame quenching distance. Furthermore, by conducting appropriate supply of combustion gas, it is possible to stably burn combustion gas in an extremely narrow combustion region within the second pipe.

Now, with respect to the combustor, when combustion gas is burned in the combustion region, the flame in the combustion region is maintained by continuously supplying combustion gas to the combustion region. However, at the time of start-up, it is necessary to ignite the combustion gas with an ignition apparatus.

Consequently, the combustor is configured with disposal of an igniter plug (flame kernel formation unit) of the ignition apparatus on the downstream side of the combustion region. Ignition of combustion gas at the time of start-up is then conducted using a flame kernel formed by the igniter plug (see, e.g., Patent Document 1).

Furthermore, as this type of combustor, for purposes of more stable burning of combustion gas, further size reduction of the combustor, and advancement of energy efficiency, a combustor has been proposed that heats combustion gas prior to burning by transferring the heat of burned gas that arises from burning of combustion gas to the combustion gas via a first pipe (see, e.g., Patent Document 2).

BACKGROUND ART LITERATURE

Patent Literature

Patent Document 1: Japanese Unexamined Patent Application, First Publication No. H1-312306

Patent Document 2: Japanese Unexamined Patent Application, First Publication No. 2004-156862

DISCLOSURE OF INVENTION

Problems that the Invention is to Solve

However, at the time of start-up, combustion gas flows at a high rate of speed through the interior of the second pipe. Consequently, as shown in Patent Document 1, in the case where an igniter plug is disposed on the downstream side of the combustion region, it is necessary to propagate the flame against the flow of combustion gas so as to form a flame in the combustion region. Depending on circumstances, there are cases where combustion gas cannot be ignited, because the flame is not satisfactorily propagated against the flow of combustion gas, and there are cases where multiple ignition operations are required.

Moreover, in the case where the igniter plug is disposed on the downstream side of the combustion region, after start-up of the combustor, the igniter plug is exposed to the high-temperature and high-speed burning gas that arises from burning of combustion gas in the combustion region. Consequently, the problem arises that igniter plug life is shortened.

On the other hand, in order to efficiently supply the heat of burned gas to the combustion gas, it is preferable to form the first pipe which constitutes the flow path of the combustion gas from material with high thermal conductivity. However, many materials that have high thermal conductivity have low thermal resistance. Consequently, in the case where the first pipe is formed from material with high thermal conductivity, the region of the first pipe that is exposed to the high-temperature environment in the vicinity of the combustion region deteriorates due to oxidation embrittlement, and the life of the combustor is shortened.

It would be conceivable to form the first pipe from material with high thermal resistance. However, as such material has low thermal conductivity, it becomes impossible to efficiently transfer the heat of burned gas to the combustion gas. Consequently, there is a risk that heating of the combustion gas will be insufficient.

The present invention was made in light of the foregoing problems, and its object is to enhance the ignitability of combustion gas and extend the life of the flame kernel formation unit of the ignition apparatus in a combustor which carries out heating by transferring the heat of burned gas to combustion gas. Another object of the present invention with respect to the combustor is to render the combustion gas sufficiently heatable, and enhance durability.

Means for Solving the Problems

The present invention adopts the following configuration in order to solve the aforementioned problems.

The first invention is a combustor including: a first pipe through the interior of which combustion gas flows and which emits the combustion gas via apertures within a flame-quenching distance; a second pipe to which the combustion gas that is emitted from the apertures of the first pipe is supplied, and within which a combustion region is formed that burns the combustion gas supplied from an upstream side, and that circulates burned gas to a downstream side; and an ignition apparatus which ignites combustion gas supplied to the second pipe using a flame kernel that is formed by a flame kernel formation unit. It also includes a low flow-rate region that is disposed on an upstream side of the combustion region inside the second pipe, wherein the flow-rate of the combustion gas through the interior of the second pipe is relatively slow, and the flame kernel formation unit is disposed in the low flow-rate region.

In a second invention, with respect to the first invention, the first pipe is an inner pipe which has the combustion gas supplied from one end, while the other end is a blocked end, and the second pipe is an outer pipe which is disposed around an outer circumference of the first pipe with interposition of the combustion region, and which discharges the combustion gas from one end, while the other end is a blocked end that is disposed at the other end side of the first pipe.

In a third invention, with respect to the second invention, a region between the blocked end of the first pipe and the blocked end of the second pipe constitutes the low flow-rate region.

In a fourth invention, with respect to the third invention, the first pipe and the second pipe is arranged concentrically and the flame kernel formation unit is singularly disposed in a central region of the blocked end of the second pipe.

In a fifth invention, with respect to the third invention, the flame kernel formation unit is fixed to the second pipe, and is arranged to be out of alignment with the direction of extension of the first pipe.

A sixth invention relates to any of the first to fifth inventions, and is a combustor which heats the combustion gas by transferring heat of burned gas that arises from burning of the combustion gas to the combustion gas via the first pipe. The first pipe is provided with a heat transfer region which is exposed to an environment that is below an oxidation corrosion temperature of formative material, and which has a relatively high thermal conductivity and a relatively low thermal resistance, as well as a heat resistant region which is exposed to an environment that is above the oxidation corrosion temperature of the formative material of the heat transfer region, and which has a relatively high thermal resistance compared to the heat transfer region.

In a seventh invention, with respect to the six invention, the first pipe is an inner pipe that has the combustion gas supplied from a first end, while the other end is a blocked end, and the second pipe is an outer pipe that is disposed around an outer circumference of the first pipe with interposition of the combustion region, and that discharges the combustion gas from one end, while the other end is a blocked end that is disposed at the other end side of the first pipe.

In an eighth invention, with respect to the sixth and seventh inventions, the heat resistant region has a relatively high thermal resistance due to a coating that is applied to the surface of the first pipe.

In a ninth invention, with respect to the sixth and seventh inventions, the heat resistant region is formed from material of higher thermal resistance than the formative material of the heat transfer region.

In a tenth invention, with respect to any of the sixth to ninth inventions, a first member that is provided with the heat transfer region and a second member that has the heat resistant region are formed as separate bodies, and the first pipe is configured by joining the first member and the second member.

Effects of the Invention

According to the present invention, a low flow-rate region is provided which is disposed on the upstream side of the combustion region, and which has a relatively slow flow-rate of combustion gas within the second pipe, and a flame kernel formation unit of an ignition apparatus is disposed in the low flow-rate region. Consequently, after a flame kernel formed in the flame kernel formation unit has ignited combustion gas in the low flow-rate region, the flame is propagated downstream through the interior of the second pipe, and reaches the combustion region. Consequently, there is no need to propagate a flame against the flow of combustion gas, and ignitability is enhanced.

Furthermore, according to the present invention, the low flow-rate region is disposed on the upstream side of the combustion region. Consequently, the flame kernel formation unit is not exposed to the high-temperature and high-speed burning gas that arises from burning of combustion gas in the combustion region. Additionally, even in the case where the combustion gas is high-temperature, as the speed of combustion gas in the low flow-rate region is slower than the speed of combustion gas in the other regions inside the second pipe, it is possible to reduce the thermal load on the flame kernel formation unit. As a result, the life of the flame kernel formation unit of the ignition apparatus is lengthened.

In this manner, according to the present invention, it is possible to enhance the ignitability to the combustion gas in the combustor, and to promote longer life of the flame kernel formation unit of the ignition apparatus.

In addition, according to the present invention, combustion gas can be heated by transferring the heat of burned gas to the combustion gas in a heat transfer region of an inner pipe 101.

Moreover, in a heat resistant region of the inner pipe 101, it is possible to prevent oxidation embrittlement of the inner pipe 101 due to the heat of burned gas.

Thus, according to the present invention, with respect to a combustor that carries out heating by transferring the heat of burned gas to combustion gas, it is possible to render combustion gas sufficiently heatable, and enhance durability.

BEST MODE FOR CARRYING OUT THE INVENTION

Figure 1:
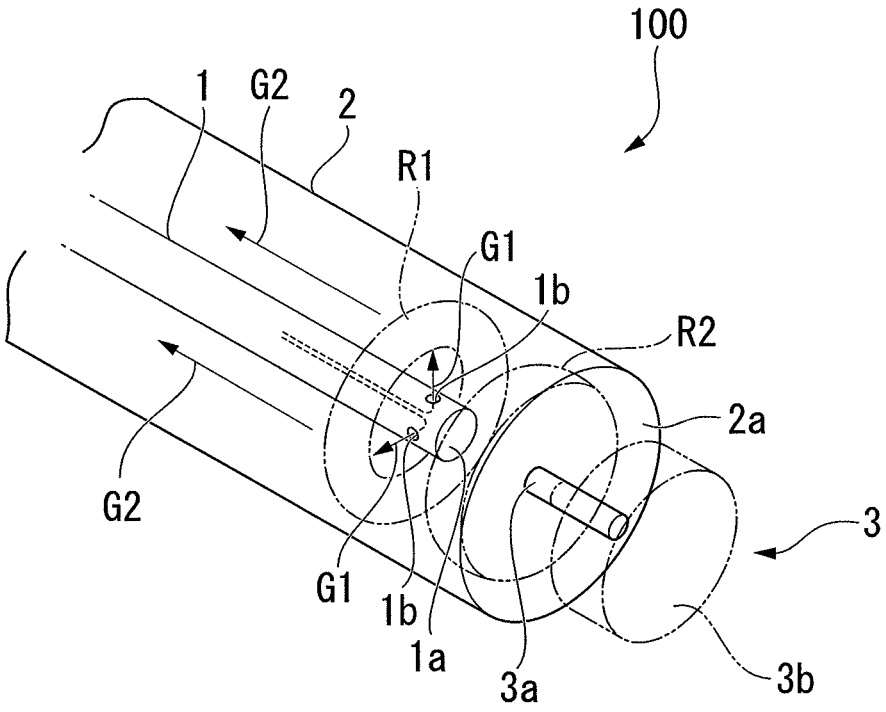
FIG. 1 is a diagrammatic perspective view which schematically illustrates the skeleton framework of a combustor of a first embodiment of the present invention.

An embodiment of the combustor of the present invention is described below with reference to drawings. In the drawings which follow, the dimensions of the various components have been appropriately modified to a size that enables recognition of the respective components.

First Embodiment

Figure 2:
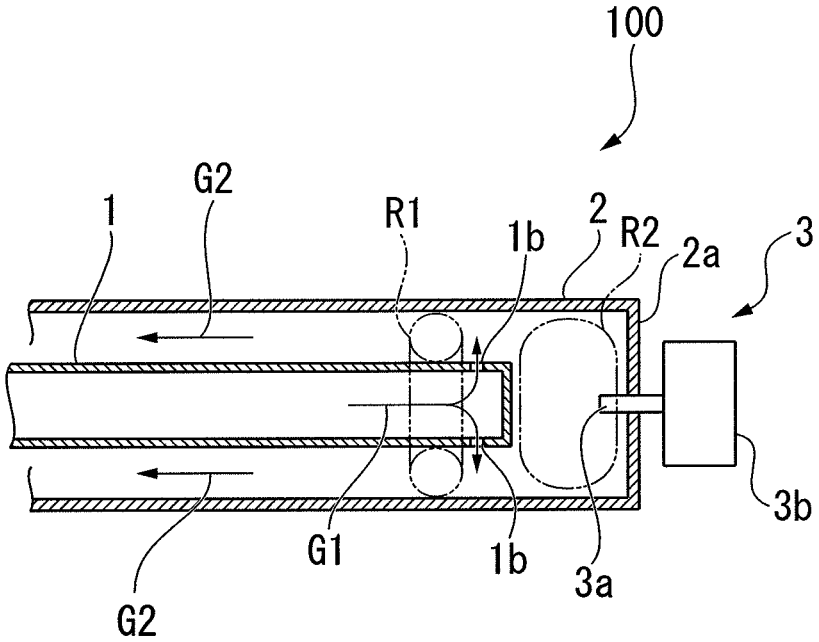
FIG. 2 is a sectional view which schematically illustrates the skeleton framework of the combustor of the first embodiment of the present invention.
Figure 3:
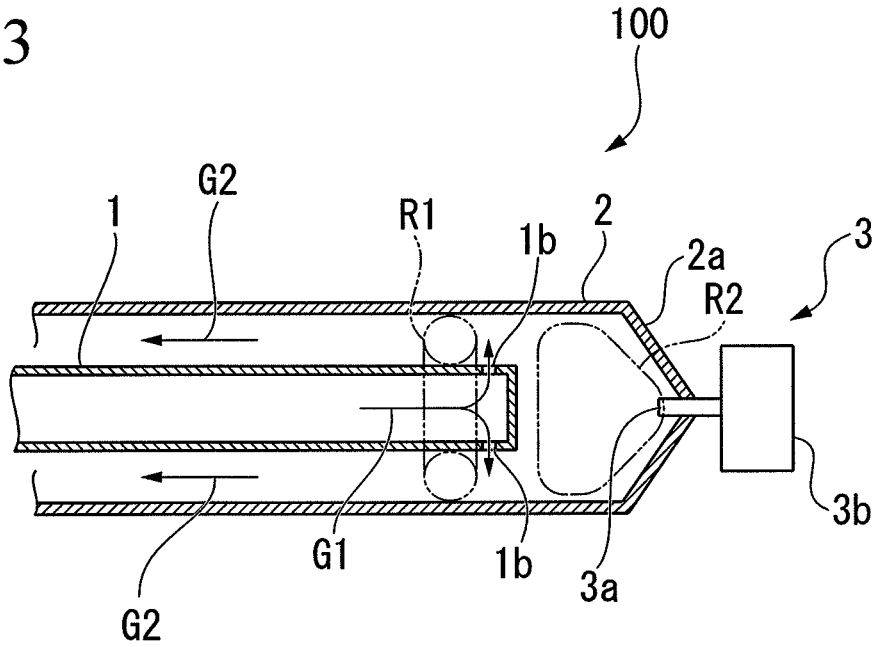
FIG. 3 is a sectional view which illustrates a variation of the combustor of the first embodiment of the present invention.

FIG. 1 and FIG. 2 are drawings which schematically illustrate the skeleton framework of the combustor of the present embodiment. FIG. 1 is a diagrammatic perspective view, and FIG. 2 is a sectional view.

As these drawings show, a combustor 100 of the present embodiment is provided with an inner pipe 1 (first pipe), an outer pipe 2 (second pipe), and an ignition apparatus 3.

The inner pipe 1 has a cylindrical shape such that combustion gas G1 is supplied to its own interior from one end, while the other end constitutes a blocked end 1*a*. The inner pipe 1 is formed from metal material that has thermal resistance.

On the circumferential surface in the vicinity of the blocked end 1*a* of this inner pipe 1, multiple apertures 1*b* are formed which emit the combustion gas G1 that is supplied to the interior of the inner pipe 1 into the exterior of the inner pipe 1. The diameters of these apertures 1*b* are set so as to be within a flame quenching distance.

The outer pipe 2 is disposed around the outer periphery of the inner pipe 1, and has a cylindrical shape such that burned gas G2 is discharged from one end, while the other end constitutes a blocked end 2*a*. As with the inner pipe 1, the outer pipe 2 is formed from metal material that has thermal resistance.

The burned gas G2 is high-temperature gas that is generated by the burning of the combustion gas G1.

As shown in FIG. 2, regions that are between the inner pipe 1 and the outer pipe 2 (i.e., inside the outer pipe 2) and on the downstream side of the apertures 1*b* of the inner pipe 1 in terms of the flow direction of the combustion gas G1 constitute a combustion region R1.

In the case where a flame is formed in this combustion region R1, the combustion gas G1 that is supplied to the combustion region R1 from the upstream side is burned in the combustion region R1. The burned gas G2 that occurs as a result flows toward the downstream side of the combustion region R1.

The blocked end 1*a* of the inner pipe 1 and the blocked end 2*a* of the outer pipe 2 are disposed in parallel in mutual opposition with separation. As combustion gas G1 is emitted from the apertures 1*b* formed on the circumferential face of the inner pipe 1 to the interior of the outer pipe 2, a cavity region R2 (low flow-rate region) which is a region wherein the flow rate of the combustion gas G1 is relatively slow inside the outer pipe 2 is constituted between the blocked end 1*a* of the inner pipe 1 and the blocked end 2*a* of the outer pipe 2. As is clear from FIG. 1 and FIG. 2, this cavity region R2 is disposed on the upstream side of the combustion region R1 relative to the flow direction of the combustion gas G1 and the burned gas G2.

The ignition apparatus 3 is provided with an igniter plug 3*a* (flame kernel formation unit) that can form a flame kernel, an energizer 3*b* that forms the aforementioned flame kernel by energizing the igniter plug 3*a*, and so on.

As the igniter plug 3*a*, one may use, for example, a spark plug or glow plug.

In the combustor 100 of the present embodiment, the igniter plug 3*a* of the ignition apparatus 3 is disposed in the cavity region R2.

More specifically, in the combustor 100 of the present embodiment, the inner pipe 1 and outer pipe 2 are concentrically arranged, and the igniter plug 3*a* is singularly disposed in the central region of the blocked end 2*a* of the outer pipe 2

The energizer 3*b* is disposed outside the outer pipe 2 in the direction of extension of the outer pipe 2, and is connected to the igniter plug 3*a*.

With respect to the distance from the blocked end 1*a* of the inner pipe 1 to the igniter plug 3*a*, even in the case where the inner pipe 1 is stretched in the extending direction of the inner pipe 1 due to thermal expansion, the distance from the blocked end 1*a* of the inner pipe 1 to the igniter plug 3*a* is set to be not less than and not equal to the flame quenching distance.

With respect to the combustor 100 of the present embodiment having such a configuration, in the case where a flame is formed in the combustion region R1 from a quenched state (that is, at the time of start-up), a flame kernel is formed by the igniter plug 3*a* of the ignition apparatus 3 in a state where the combustion gas G1 is supplied to the interior of the inner pipe 1 from one end of the inner pipe 1.

When a flame kernel is formed by the igniter plug 3*a* in this manner, the flame kernel ignites the combustion gas G1 that has accumulated in the cavity region R2. The flame formed by this ignition is propagated downstream through the interior of the outer pipe 2, reaches the combustion region, and stabilizes burning.

Here, in the combustor 100 of the present embodiment, the igniter plug 3*a* is disposed on the upstream side of the combustion region.

Consequently, after a flame kernel which is formed by the igniter plug 3*a* ignites the combustion gas G1 of the cavity region R2, the flame is propagated downstream through the interior of the outer pipe 2 (the region sandwiched by the inner pipe 1 and the outer pipe 2) relative to the flow direction of combustion gas G1, and reaches the combustion region. As a result, in the combustor 100 of the present embodiment, there is no need to propagate the flame against the flow of the combustion gas G1, and ignitability is enhanced.

Moreover, according to the combustor 100 of the present embodiment, as the igniter plug 3*a* is disposed on the upstream side of the combustion region R1, the igniter plug 3*a* is not exposed to the high-temperature and high-speed burned gas G2 that arises from the burning of the combustion gas G1 in the combustion region R1.

Even in the case where the combustion gas G1 being high temperatures due to thermal exchange with the burned gas G2 via the inner pipe 1, as the speed of the combustion gas G1 in the cavity region R2 is slower than in the other regions inside the outer pipe 2, it is possible to mitigate thermal load on the igniter plug 3*a*. Accordingly, the life of the igniter plug 3*a* of the ignition apparatus 3 is lengthened.

In this manner, according to the combustor 100 of the present embodiment, it is possible to promote enhancement of ignitability of the combustion gas G1, and lengthening of the life of the igniter plug 3*a* of the ignition apparatus 3.

In addition, in the combustor 100 of the present embodiment, the inner pipe 1 and the outer pipe 2 are concentrically arranged, and the igniter plug 3*a* is disposed in the central region at the blocked end 2*a* of the outer pipe 2.

Consequently, the distance from the igniter plug 3*a* to the combustion region R1 is equal across the entire circumference of the combustor 100, and propagation of the flame from the igniter plug 3*a* to the combustion region R1 uniformly spreads across the entire circumference of the combustor 100, enabling achievement of stable flame propagation.

Otherwise, in the present embodiment, description was given of a configuration wherein the blocked end 2*a* of the outer pipe 2 to which the igniter plug 3*a* is fixed is flat, and parallels the blocked end 1*a* of the inner pipe 1.

However, it is also acceptable to have a configuration wherein, for example, the blocked end 2*a* of the outer pipe 2 is inclined toward the igniter plug 3*a*.

By adopting the foregoing configuration, the propagation path of flame from the igniter plug 3*a* to the combustion region R1 is smoothened, enabling achievement of more stable flame propagation.

Second Embodiment

Next, a second embodiment of the present invention is described. In the description of the second embodiment, description of components identical to those of the foregoing first embodiment is omitted or abbreviated.

Figure 4:
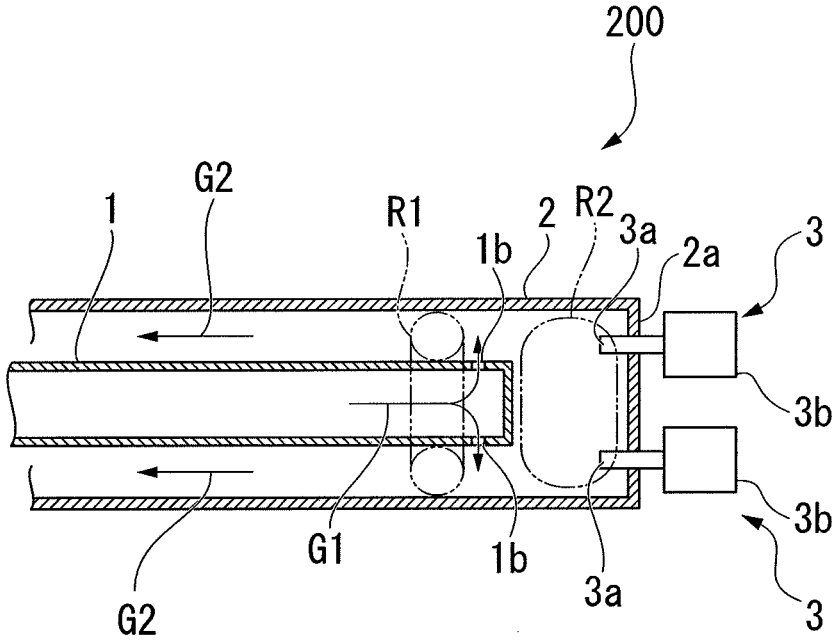
FIG. 4 is a sectional view which schematically illustrates the skeleton framework of a combustor of a second embodiment of the present invention.

FIG. 4 is a sectional view which schematically illustrates the skeleton framework of a combustor 200 of the present embodiment.

As shown in this drawing, in the combustor 200 of the present embodiment, the igniter plug 3*a* of the ignition apparatus 3 is fixed to the blocked end 2*a* of the outer pipe 2 so as to be arranged out of alignment with the direction of extension of the inner pipe 1. Furthermore, the combustor 200 of the present embodiment is provided with multiple igniter plugs 3*a*.

According to the combustor 200 of the present embodiment having the foregoing configuration, even in the case where the inner pipe 1 stretches in the direction of extension of the inner pipe 1 due to thermal expansion, it is possible to prevent excessive interference and proximity of the blocked end 2*a* of the inner pipe 1 and the igniter plugs 3*a*.

Figure 5:
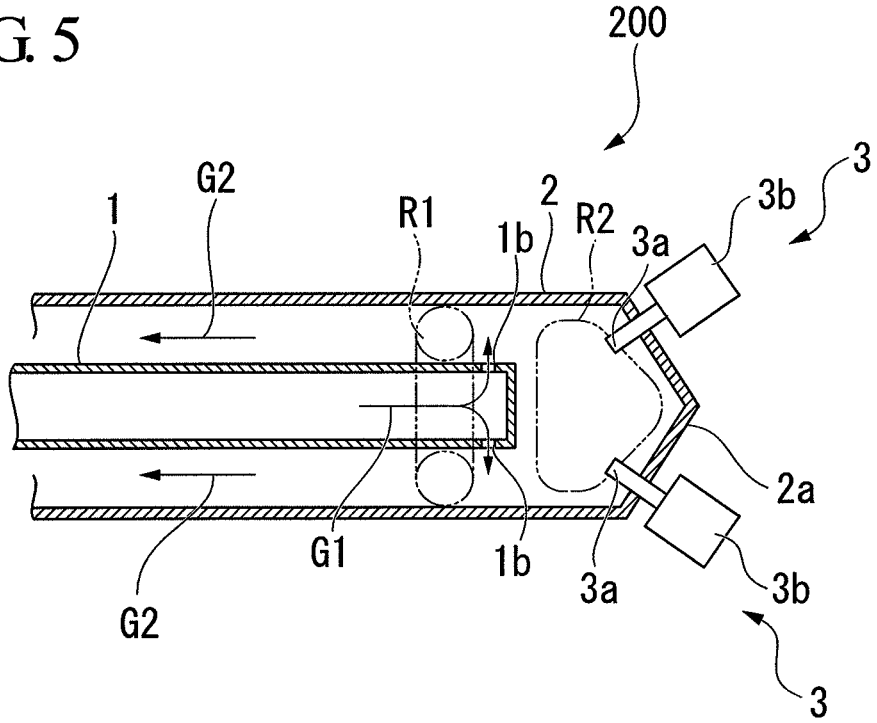
FIG. 5 is a sectional view which illustrates a variation of the combustor of the second embodiment of the present invention.

With respect to the combustor 200 of the present embodiment, as shown in FIG. 5, it is also acceptable to have a configuration wherein the blocked end 2*a* of the outer pipe 2 is inclined toward the igniter plugs 3*a*.

By adopting such a configuration, the propagation paths of flame from the igniter plugs 3*a* to the combustion region R1 is smoothened, enabling achievement of more stable flame propagation.

Third Embodiment

Figure 7:
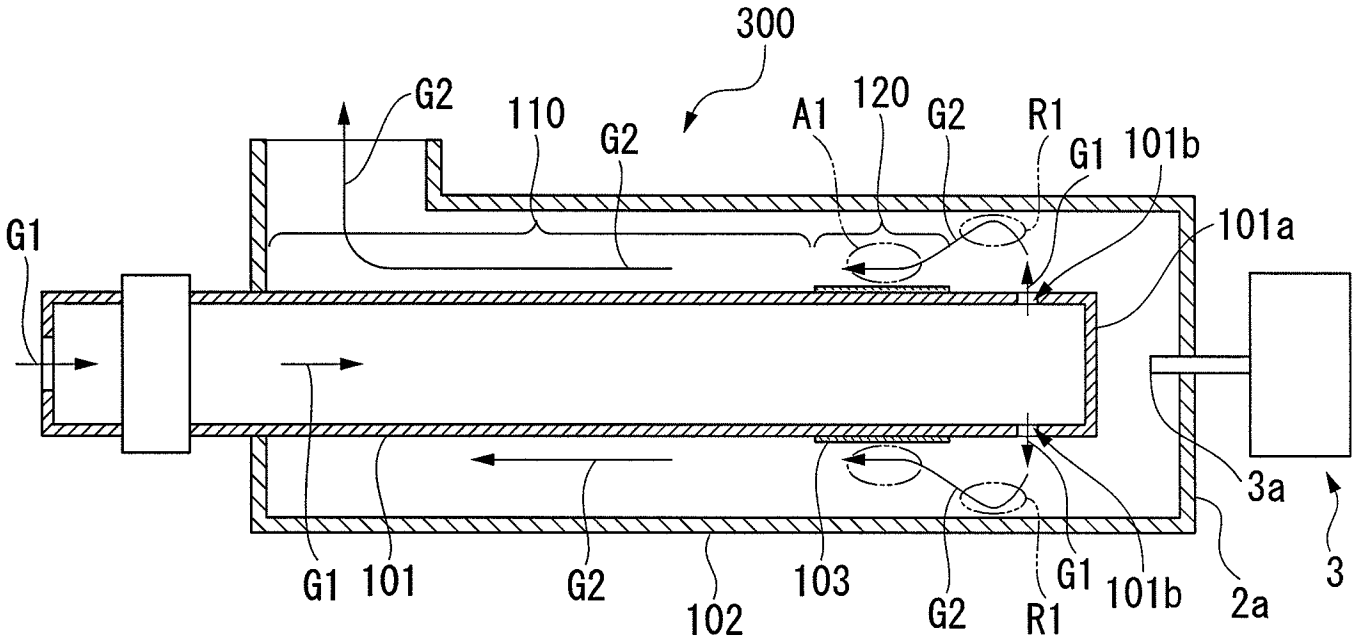
FIG. 7 is a sectional view which schematically illustrates the skeleton framework of a combustor of a third embodiment of the present invention.

FIG. 7 is a sectional view which schematically illustrates the skeleton framework of a combustor 300 of the present embodiment. In the present embodiment, as the structure and positional relations of an inner pipe 101, outer pipe 102, blocked ends 101*a* and 102*a*, and apertures 101*b* are respectively identical to the inner pipe 1, outer pipe 2, blocked end 1*a*, blocked end 2*a*, and apertures 1*b* of the foregoing first embodiment, description thereof is omitted.

In the present embodiment, the combustion gas G1 emitted from the apertures 101*b* impacts the inner wall surface of the outer pipe 102, the flow rate of the combustion gas G1 lowers.

As a result, the combustion region R1 is stably formed in the region where the flow rate is lowered, that is, in the vicinity of the inner wall surface of the outer pipe 102.

Moreover, as shown by the arrow marks in FIG. 7, the burned gas G2 produced by burning of the combustion gas G1 in the combustion region R1 flows toward the side ends of the outer pipe 2, and approaches the outer wall surfaces of the inner pipe 1 due to repulsive force from the impact of the combustion gas G1 against the outer pipe 2.

As a result of this type of flow of the combustion gas G1 and burned gas G2, as shown in FIG. 7, a region A1 inside the inner pipe 101 which is on the downstream side of the combustion region R1 and which is near to this combustion region R1 is exposed to a relatively high-temperature environment.

The inner pipe 101 is exposed to a relatively low-temperature environment as it heads farther downstream in the discharge direction of the burned gas G2 from the region A1.

The region which is on the upstream side of the discharge direction of the burned gas G2 from the region A1 of the inner pipe 101 is cooled by the combustion gas G1 that is emitted from the apertures 101*b* of the inner pipe 101. Consequently, the inner pipe 101 is exposed to a low-temperature environment relative to the region A1.

In the combustor 300 of the present embodiment, the temperature distribution to which the inner pipe 101 is exposed is obtained in advance through actual measurements or simulation, and the inner pipe 101 is divided by region into a heat transfer region 110 wherein thermal conductivity is relatively high and thermal resistance is relatively low, and a heat resistant region 120 wherein thermal resistance is relatively high compared to the heat transfer region 110.

Specifically, in the present embodiment, the heat transfer region 110 is a region exposed to a temperature environment that is below the oxidation corrosion temperature of the formative material of the heat transfer region 110.

Moreover, the heat resistant region 120 is a region exposed to a temperature environment that is above the oxidation corrosion temperature of the formative material of the heat transfer region 110.

That is, the inner pipe 101 in the combustor 300 of the present embodiment is provided with a heat transfer region 110 which is exposed to an environment that is below the oxidation corrosion temperature of the formative material, and which has relatively high thermal conductivity and relatively low thermal resistance, and a heat resistant region 120 which is exposed to an environment that is above the oxidation corrosion temperature of the formative material of the heat transfer region 110, and which has relatively high thermal resistance compared to the heat transfer region 110.

This heat resistant region 120 necessarily includes the aforementioned region A1 of the inner pipe 101 that is exposed to a relatively high-temperature environment.

In the combustor 300 of the present embodiment, the region on the upstream side of the region A1 of the inner pipe 101 relative to the discharge direction of the burned gas G2 is formed from the same material as the heat transfer region 110.

In short, in the combustor 300 of the present embodiment, the sole region that is exposed to an environment that is above the oxidation corrosion temperature of the formative material of the heat transfer region 110 of the inner pipe 101 is the heat resistant region 120.

In the combustor 300 of the present embodiment, as shown in FIG. 7, the heat resistant region 120 has a relatively high thermal resistance due to a coating 103 that is applied to the surface of the inner pipe 101.

As the formative material of the inner pipe 101, one may use carbon steel and stainless steel (e.g., SUS 321 or SUS 304). As the formative material of the coating 103, one may use ceramics.

For example, in the case where stainless steel is used as the formative material of the inner pipe 101 and where ceramics is used as the formative material of the coating 103, the heat transfer region 110 is formed only from stainless steel and the heat resistant region 120 has a double-layer structure of stainless steel and a ceramic layer.

In the combustor 300 of the present embodiment having the foregoing configuration, when combustion gas G1 is supplied to the inner pipe 101, in the process of flowing through the inner pipe 101, the combustion gas G1 is heated via the inner pipe 101 by the heat of the burned gas G2 that flows along the outer side of the inner pipe 101.

The heated combustion gas G1 is emitted from the apertures 101*b* of the inner pipe 101 into the space between the inner pipe 101 and the outer pipe 102, and is burned in the combustion region R1.

Burned gas G2 is generated by the burning of the combustion gas G1 in the combustion region R1, and this burned gas G2 transits the interior of the outer pipe 102, and is discharged to the outside.

Here, in the combustor 300 of the present embodiment, the inner pipe 101 is provided with a heat transfer region 110 which is exposed to an environment that is below the oxidation corrosion temperature of the formative material, and which has relatively high thermal conductivity and relatively low thermal resistance, and a heat resistant region 120 which is exposed to an environment that is above the oxidation corrosion temperature of the formative material of the heat transfer region 110, and which has relatively high thermal resistance compared to the heat transfer region 110.

Consequently, it is possible to prevent oxidation embrittlement of the inner pipe 101 in the heat resistant region 120, and transfer the heat of the burned gas G2 to the combustion gas G1 in the heat transfer region 110.

In this manner, according to the combustor 300 of the present invention, the combustion gas G1 is heated by transferring the heat of the burned gas G2 to the combustion gas G1 in the heat transfer region 110 of the inner pipe 101.

Moreover, in the heat resistant region 120 of the inner pipe 1, it is possible to prevent oxidation embrittlement of the inner pipe 101 by the heat of the burned gas.

Thus, according to the combustor 300 of the present embodiment, in a combustor that performs heating by transferring the heat of burned gas to combustion gas, it is possible to sufficiently heat the combustion gas, and enhance durability.

In addition, according to the combustor 300 of the present embodiment, only a region that is exposed to an environment that is above the oxidation corrosion temperature of the formative material of the heat transfer region 110 of the inner pipe 101 is the heat resistant region 120, and a coating 103 is applied only to the heat resistant region 120.

In short, the area where the coating 103 is applied is kept to a minimum.

Consequently, it is possible to inhibit peeling of the coating 103 that originates in the thermal elongation differential of the formative material (ceramic material) of the coating 103 and the formative material (metal material) of the heat transfer region 110 of the inner pipe 101.

Fourth Embodiment

Next, a fourth embodiment of the present invention is described.

In description of the fourth embodiment, description of portions identical to the third embodiment is either omitted or abbreviated.

Figure 8:
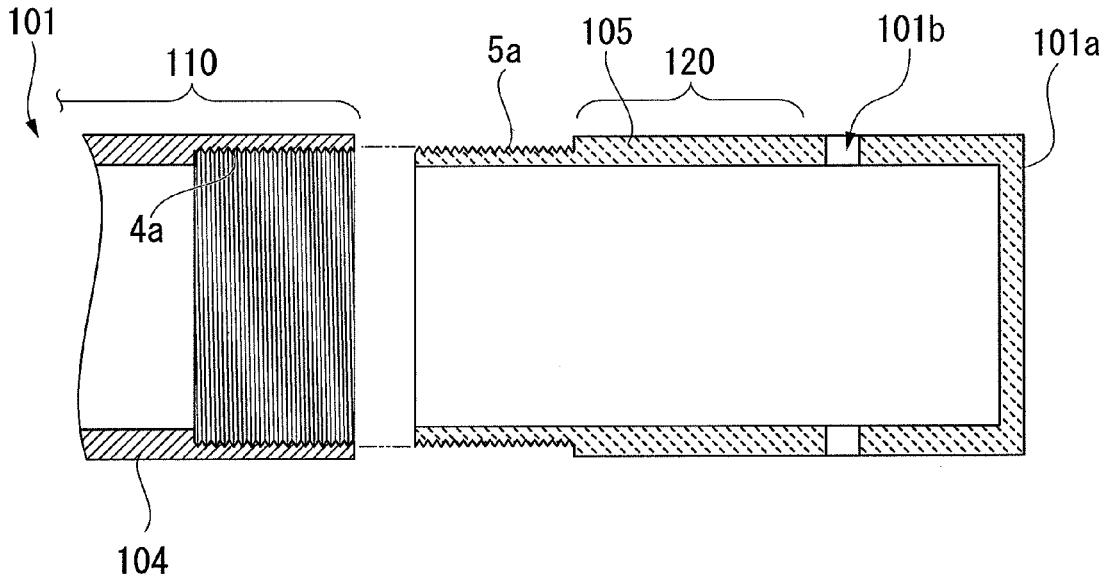
FIG. 8 is an exploded sectional view of an inner pipe with which a combustor of a fourth embodiment of the present invention is provided.

FIG. 8 is an exploded sectional view of an inner pipe 101 with which the combustor of the present embodiment is provided.

As shown in this drawing, with respect to the inner pipe 101 with which the combustor of the present embodiment is provided, a first member 104 provided with the heat transfer region 110 and a second member 105 provided with the heat resistant region 120 are joined by fitting together a screw structure.

In the combustor of the present embodiment, a female screw 104*a* is formed in the first member 104, and a male screw 105*a* is formed in the second member 105.

However, it is also acceptable to form the male screw in the first member 104, and form the female screw in the second member 105.

In the combustor of the present embodiment, the first member 104 is formed from material that has relatively high thermal conductivity and relatively low thermal resistance. As a result of this configuration, the heat transfer region 110 has relatively high thermal conductivity.

On the other hand, the second member 105 is formed from material with a higher thermal resistance than the formative material of the heat transfer region 110.

As a result of this configuration, the heat resistant region 120 has a high thermal resistance.

As the formative material of the first member 104, one may use carbon steel or stainless steel (e.g., SUS321, SUS304, SUS316, and SUS310). As the formative material of the second member 105, one may use ceramics.

In the combustor of the present embodiment having the foregoing configuration, as with the third embodiment, the combustion gas G1 is heated by transferring the heat of the burned gas G2 to the combustion gas G1 in the heat transfer region 110 of the inner pipe 1.

Moreover, in the heat resistant region 120 of the inner pipe 101, it is possible to prevent oxidation embrittlement of the inner pipe 101 by the heat of the burned gas.

Thus, according to the combustor of the present embodiment, in a combustor that performs heating by transferring the heat of burned gas to combustion gas, it is possible to sufficiently heat the combustion gas, and enhance durability.

While preferred embodiments of the invention have been described and illustrated above, it should be understood that these are exemplary of the invention, and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

For example, in the foregoing embodiments, a combustor of double-pipe structure is described wherein an inner pipe 1 is provided as the first pipe of the present invention, an outer pipe 2 is provided as the second pipe of the present invention, and the inner pipe 1 and outer pipe 2 are concentrically arranged.

Figure 6:
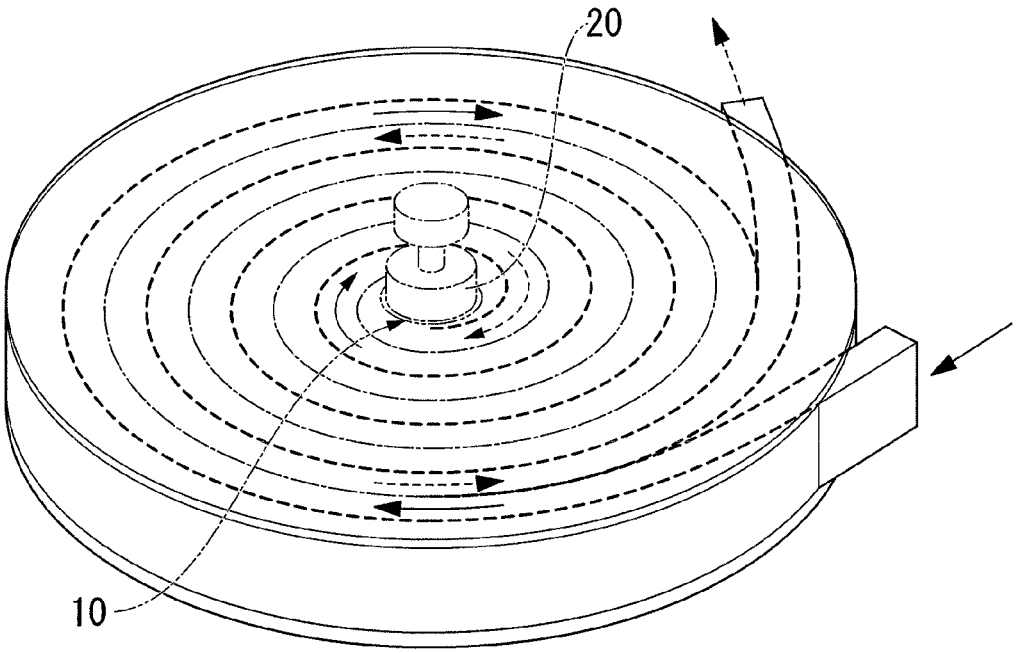
FIG. 6 is a skeleton framework of a Swiss-roll combustor which is a variation of the present invention.

However, the present invention is not limited thereto. For example, as shown in FIG. 6, it may be applied to a so-called Swiss roll type combustor wherein the first pipe and the second pipe are arranged so as to wind around a central combustion chamber that constitutes the combustion region. In the case where the present invention is applied to this type of Swiss roll combustor, as shown, for example, in FIG. 5, it is acceptable to form within the second pipe 10 a separate chamber 20 that communicates with the combustion chamber and that has a relatively slow flow rate of combustion gas on its inner side, and to use the inner side of this separate chamber 20 as the cavity region R2 where the igniter plugs 3*a* are disposed.

In addition, the present invention may also be applied to the so-called disk-type combustor recorded, for example, in Japanese Patent Application, First Publication No. 2007-212082.

Moreover, in the foregoing embodiments, configurations were described wherein the region between the blocked end 1*a* of the inner pipe 1 and the blocked end 2*a* of the outer pipe 2 constitutes the cavity region R2.

However, the present invention is not limited thereto, and it is also acceptable to form a separate chamber that is connected to the region between the blocked end 1*a* of the inner pipe 1 and the blocked end 2*a* of the outer pipe 2, and place the cavity region on the inner side of this separate chamber.

In addition, in the case where, for example, the flow rate of combustion gas in the cavity region R2 is insufficiently slow, it is also acceptable to dispose a flow-rate reduction member, which lowers the flow rate of combustion gas, in the cavity region.

In the foregoing embodiments, configurations were described wherein an igniter plug 3*a* is used as the flame kernel formation unit of the present invention.

However, the present invention is not limited thereto, and one may use any device that is capable of forming a flame kernel (spark) as the flame kernel formation unit of the present invention.

Moreover, in the foregoing embodiments, a combustor of double-pipe structure is described wherein an inner pipe 101 is provided as the first pipe of the present invention, an outer pipe 102 is provided as the second pipe of the present invention, and the inner pipe 101 and outer pipe 102 are concentrically arranged.

However, the present invention is not limited thereto, and may also be applied, for example, to a so-called Swiss roll type combustor wherein the first pipe and the second pipe are arranged so as to wind around a central combustion chamber that constitutes the combustion region.

In addition, the present invention may also be applied to the so-called disk-type combustor recorded, for example, in Japanese Patent Application, First Publication No. 2007-212082.

In the foregoing embodiments, configurations were described wherein the formative materials of the coating 103 and the second member 105 are ceramics.

However, the present invention is not limited thereto, and it is also acceptable to form the coating 103 and the second member 105 from other heat resistant material which has higher thermal resistance than the formative material of the heat resistant region 120.

INDUSTRIAL APPLICABILITY

According to the present invention, it is possible to enhance the ignitability of combustion gas in the combustor, and the durability of the flame kernel formation unit of the ignition apparatus. Moreover, in a combustor that performs heating by transferring the heat of burned gas to combustion gas, combustion gas can be rendered sufficiently heatable, and durability can be enhanced.

The invention claimed is:

1. A combustor comprising:

a first pipe through an interior of which flows combustion gas formed by mixing fuel and an oxidant and which emits the combustion gas outward in a radial direction thereof via apertures within a flame-quenching distance;

a second pipe to which the combustion gas that is emitted from the apertures of the first pipe is supplied, and including a combustion region that burns the combustion gas supplied from an upstream side, and that circulates burned gas to a downstream side; and an ignition apparatus which ignites combustion gas supplied to the second pipe using a flame kernel that is formed by a flame kernel formation unit;

wherein the first pipe is an inner pipe which has the combustion gas supplied from a first end, while a second end is a blocked end;

the second pipe is an outer pipe which is disposed around an outer circumference of the first pipe with interposition of the combustion region, and which discharges the combustion gas from one end, while another end is a blocked end that is disposed near the second end of the first pipe;

a cavity region is formed by the combustion gas emitted from the apertures of the first pipe flowing toward the one end of the second pipe through the combustion region, the cavity region being formed on the upstream side of the combustion region within the second pipe, between the blocked end of the first pipe and the blocked end of the second pipe, wherein a flow rate of the combustion gas in the cavity region is less than a flow rate of the combustion gas in the combustion region, the flame kernel formation unit is disposed in the cavity region, the flame kernel formation unit and the first pipe are disposed in series in a longitudinal direction of the first pipe, and the flame kernel formation unit is positioned so that a distance from the blocked end of the first pipe to the flame kernel formation unit is maintained to be greater than the flame-quenching distance even when the first pipe is stretched, due to thermal expansion, in the longitudinal direction of the first pipe.

2. The combustor according to claim 1, wherein the first pipe and the second pipe is arranged concentrically and the flame kernel formation unit is singularly disposed in a central region of the blocked end of the second pipe.

3. The combustor according to claim 1, which heats the combustion gas by transferring heat of burned gas that arises from burning of the combustion gas to the combustion gas via the first pipe, wherein the first pipe comprises a heat transfer region and a heat resistant region;

the heat transfer region is exposed to an environment that is below an oxidation corrosion temperature of the heat transfer region, and has a higher thermal conductivity and a lower thermal resistance than the heat resistant region; and the heat resistant region is exposed to an environment that is above the oxidation corrosion temperature of the heat transfer region, and has a higher thermal resistance than the heat transfer region.

4. The combustor according to claim 3, wherein the heat resistant region has a higher thermal resistance than the heat transfer region due to a coating that is applied to the surface of the first pipe.

5. The combustor according to claim 3, wherein the heat resistant region is formed from material of higher thermal resistance than the heat transfer region.

6. The combustor according to claim 3, wherein a first member that is provided with the heat transfer region and a second member that has the heat resistant region are formed as separate bodies, and the first pipe is configured by joining the first member and the second member.

* * * * *